United States Patent [19]

Rividi

[11] 4,388,565

[45] Jun. 14, 1983

[54] CONTROL CIRCUIT FOR A DISCHARGE LAMP

[75] Inventor: Jan Rividi, Paris, France

[73] Assignee: Elam Limited, Dublin, Ireland

[21] Appl. No.: 217,868

[22] Filed: Dec. 18, 1980

[30] Foreign Application Priority Data

Dec. 19, 1979 [FR] France ..... 79 31108

[51] Int. Cl.[3] ..... H05B 41/392

[52] U.S. Cl. ..... 315/291; 315/199; 315/226; 315/DIG. 4; 315/DIG. 7

[58] Field of Search ..... 315/194, 199, 208, 209 R, 315/226, 291, 307, 311, DIG. 4, DIG.7; 323/235, 319, 905

[56] References Cited

U.S. PATENT DOCUMENTS 3,793,557 2/1974 Cramer ..... 315/199

4,320,326 3/1982 Banziger et al. ..... 315/307

OTHER PUBLICATIONS

Burkhart et al., *Reverse Phase-Controlled Dimmer,* IEEE Trans. on Industry Applications, vol. 1A-15, Sep./Oct. 1979, pp. 579-583.

*Primary Examiner*—Eugene R. La Roche

*Attorney, Agent, or Firm*—DeLio and Libert

[57] ABSTRACT

A control device for a discharge lamp, comprising an electronic switch connected between an AC supply source and a loading circuit including the discharge lamp to be controlled, and a control circuit delivering pulses to a control electrode of the switch so as to control the state of conduction thereof; the control circuit comprises means for detecting the passages through zero of the voltage at the terminals of the loading circuit and generating means responsive to the detecting means for generating pulses controlling the passage of the switch to the non-conductive state, whereby non-conduction periods of the switch are controlled for an adjustable duration in response to the passages through zero of the voltage at the terminals of the loading circuit.

13 Claims, 3 Drawing Figures

CONTROL CIRCUIT FOR A DISCHARGE LAMP

The present invention relates to a control device for an electric load, in particular for a discharge lamp.

A non-limitative application field of the invention is the control of discharges lamps used in external lighting installations.

Problems are encountered for controlling a discharge lamp, which problems result, on the one hand, from the nature of the impedance exhibited by such a lamp, and, on the other hand, from the conditions of use of the lamp.

One knows that the voltage between the terminals of a discharge lamp increases first as the current through the lamp is increasing, then this voltage reaches a maximum and decreases in the usual operating zone, the impedance being then negative. This is the reason why an inductance or ballast is to be used. Under these conditions, the control circuits used generally for controlling resistive loads are not well adapted.

Regarding now the conditions of use of the discharge lamps, it is frequently necessary to provide an adjustable intensity of radiated light, in particular in case of external light installations so as to minimize the consumption of energy.

For both these reasons, particular control circuits have been proposed including an electronic switch such as a thyristor or a triac, i.e. a semi conductor device of the triode type which is adapted to operate with alternative current. Such a device has a control electrode for receiving a voltage pulse of adjustable length, whereby the conduction of the switch and the turning on of the lamp is controlled during an adjustable time period. Generally, the switching of the triac or thyristor is controlled when the supply voltage passes through zero in order to reduce the electrical interference caused by the switching operation.

Such control circuits are described in particular:

in an article of P. R. SAMUELS entitled "Semi-conductor ballast circuits for discharge lamp" published in "LIGHTING RESEARCH AND TECHNOLOGY", Vol. 7, No. 2, 1975, pp. 133–141; and in a handbook published by the company of the United States of America R.C.A. and entitled "Solid State—Linear Integrated Circuits" SSD 240A, 1978, pp. 127–131 and 503–517.

All such known control circuits exhibit various drawbacks. First, the switching occurs when the supply voltage passes through zero. A phase difference exists between this moment and the moment when the voltage at the terminals of the discharge lamp passes through zero, due to the particular impedance of the lamp. This phase difference may vary between different discharge lamps and may even vary for a same lamp during the service life thereof. This is detrimental to a good working of the lighting installation because the control circuit is not necessarily well adapted to the charge to be controlled.

In addition, the switching is produced by an electrical pulse which causes the switch to be closed, and this leads to some incertainty regarding the exact triggering moment.

The object of the invention is to eliminate these drawbacks and to provide a control device for precisely controlling an electrical load such as a discharge lamp, and eliminating the problems raised by the phase difference between the instants of passing through zero of the supply voltage and of the voltage between the terminals of the electrical load.

This object is attained by a control device including: an electronic switch having a control electrode and connected between a terminal for connection with an alternative current supply source and a terminal for connection with a loading circuit including the electric load to be controlled; and a control circuit for delivering control signals applied to said control electrode for controlling the state of said switch, wherein said control circuit comprises a circuit for detecting the passages through zero of the voltage at the terminals of said loading circuit, generating means connected to said detecting circuit and responsive to passages through zero of the current through said electrical load for providing pulses having an adjustable duration, and means for applying said control pulses to said control electrode to control the passage of said electronic switch to the non-conductive state in response to said control pulses.

The switching of the load is then realized when the voltage at the terminals thereof passes through zero. Electrical interferences are then reduced to a minimum at the switching times.

In addition, contrary to the prior art, the control pulse applied to the control electrode causes the switch to be non-conductive. Consequently, should the working of the control device become defective, the control of the switch to the non-conductive state will generally not occur and the loading circuit will be fed without interruption. This is a significant advantage in the case where the loading circuit includes a discharge lamp of an external lighting installation.

According to a particular embodiment of the invention, the control pulses generating means comprises a monostable circuit which is triggered by signals delivered by said zero crossing detecting circuit.

The adjustment of the periods of non-conduction, and thereby of the periods of conduction of the switch is then quite easy to realize.

Preferably, the zero-crossing detecting circuit comprises two symmetrical detecting paths receiving respectively the negative alternations and the positive alternations of the voltage at the terminals of the loading circuit, and responsive respectively to the passages through zero of positive alternations and negative alternations of the current through said electric load for delivering first and second signals on respective separate outputs of said detecting circuit. Still preferably, the control pulses generating means receive said first and second signals for delivering in response first and second control pulses of same duration.

Only one adjusting means is provided for adjusting the duration of the control pulses relative to the two detecting paths. Possible differences between the durations of conduction for the positive and negative alternations are then avoided. When the load is a discharge lamp, any possibility of blinking of the lamp is then eliminated.

The invention will be more readily understood on reading the following description with reference to the accompanying drawings in which.

Figure 1:
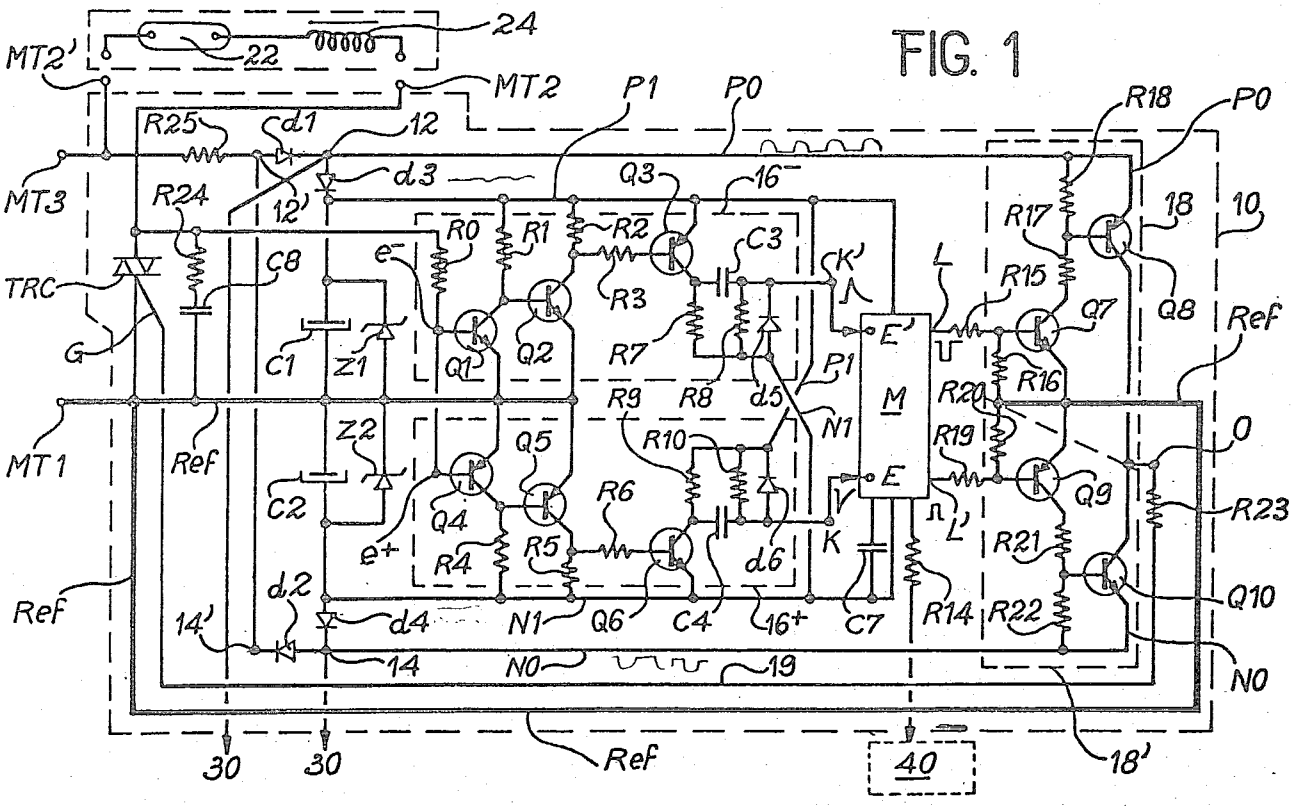
FIG. 1 is a diagram of a control device according to the invention.

The device illustrated in FIG. 1 comprises, in known manner, two connection terminals MT1 and MT3 connecting it to an A.C. mains supply, two connection terminals MT2 and MT2' connecting it to a loading circuit including a discharge lamp 22 and a ballast 24 and an electronic switch TRC which will be presumed hereinafter to be a "triac". Said switch is provided with a control electrode G and it is inserted between the terminals MT1 and MT2. The device further comprises a circuit 10 for controlling the state of conduction of the switch, said member delivering a voltage pulse which is applied to the electrode G.

The control circuit 10 comprises first of all, five conductive supply lines which are respectively:

(a) a conductive line Po connected to the terminal MT3 via a first diode d1 directly mounted for the positive alternations of the mains phase present in MT3. Said line Po is thus brought to a voltage which follows the positive alternations of said phase;

(b) a conductive line No connected to the terminal MT3 by a second diode d2 directly mounted for the negative alternations of the mains phase present in MT3. Said line No is thus brought to a voltage which follows the negative alternations of said phase;

(c) a conductive reference line Ref connected to the input terminal MT1. Said line is thus brought to a voltage which follows the mains phase in MT1, which phase constitutes a reference voltage for the control member, (d) a conductive line P1 connected to the terminal MT3, if necessary via the first diode d1 (as illustrated), by a third diode d3 mounted as d1 and connected to the line Ref by a circuit comprising a Zener diode Z1 and a shunt capacitor c1; said line is brought to a positive voltage;

(e) a conductive line N1 connected to the terminal MT3, if necessary via the second diode d2 (as illustrated), by a fourth diode d4 mounted as d2 and connected to the line Ref via a circuit comprising a Zener diode Z2 and a shunt capacitor C2; said line is thus brought to a negative voltage.

The control circuit further comprises a detector circuit for detecting the zero-crossing of the voltage at the load terminals, comprising at least one of the two following paths:

(i) a first path 16+ for detecting the passage through zero of the positive part of the said voltage at the load terminals, said path comprising a signal input e+ connected to the terminal MT2 via a resistor Ro and means to deliver a pulse, on an output K, at said zero crossing; said path is supplied by the line N1;

(ii) a second path 16− for detecting the passage through zero of the negative part of the said voltage, at the load terminals, said second path being symmetrical to the first one and comprising a signal input e− connected to the terminal MT2, and means to deliver a pulse on an output K', which pulse is of reverse polarity to the first at said zero-crossing; said second path is supplied by the line P1.

Said control circuit further comprises a single monostable circuit M of adjustable time period $\theta$ defined by an adjustable resistor of which one fixed part R14 is placed in the member 10 and an adjustable part is included in an adjusting circuit 40 whose structure will be described in reference to FIG. 2. The monostable circuit M comprises two supplementary inputs E and E' connected respectively to the outputs K and K' of the paths 16+ and 16− and two outputs L and L' delivering two rectangular complementary pulses of duration $\theta$.

The control circuit is completed by a control voltage-forming circuit for controlling the switch TRC, which comprises at least one of the two following circuits:

(i) a first circuit 18 supplied by the lines Po and Ref and provided with an input connected to the output L of the monostable M via a resistor R15 and an output O; said circuit comprises means capable of delivering on the output O a pulse of zero voltage during the period $\theta$ of the pulse appearing at the output L of the monstable M and which follows the positive voltage of the line Po outside said period, (ii) a second circuit 18', symmetrical to the first, supplied by the lines No and Ref; said circuit comprises a control input connected to the output L' of the monostable M via a resistor 19 and the same output O as the first circuit; said circuit 18− comprises means capable of delivering on said output a pulse of Zero voltage during the period $\theta$ of the pulse appearing at the output L' of the monostable and which follows the negative voltage of the line No outside said period.

Finally, a connection line 19 connects, via a resistor R23, the output O to the control electrode G of the switch TRC.

Moreover, a circuit R24-C8 is inserted between the terminal MT2 and the line Ref and a resistor R25 between MT3 and the diodes d1 and d2.

In the variant illustrated in FIG. 1, the detecting paths 16− and 16+ of zero-crossing of the voltage at the load terminals each comprise: a first transistors Q1, Q4 with a base connected to MT2 via a resistor Ro, a collector connected to the line P1 for the first path and to the line N1 for the second, via a resistor R1, R4, a transmitter connected to the line Ref; a second transistor Q2, Q5 whose base is connected to the collector of the first transistor, a transmitter connected to the line Ref and a collector connected to the line P1 for the first path and to the line N1 for the second, via a resistor R2, R5; a third transistor Q3, Q6 whose base is connected to the collector of the second transistor via a resistor R3, R6, a transmitter connected to the line P1 for the first path and to the line N1 for the second and a collector connected to the line N1 for the first path and to the line P1 for the second, via a resistor R7, R9, the transmitter-collector circuit of this third transistor being thus inserted between the positive line P1 and the negative line N1; and a differentiator circuit constituted by a capacitor C3, C4, a resistor R8, R10, and a diode d5, d6, said circuit being connected to the collector of the third transistor. Said paths deliver on their output terminal K, K' respective pulses which mark the zero-crossing of the voltage at the load terminals, a negative pulse for the positive alternation and a positive pulse for the negative alternation.

Concerning the control pulse-forming circuits 18 and 18', each of these comprises: a first transistor Q7, Q9 whose base is connected to one of the outputs L, L' of the monostable M via a resistor R15, R19, a transmitter connected to the line Ref, a collector connected via a resistor R17, R21 to the base of the second transistor; and a second transistor Q8, Q10 whose base is connected to the transmitter via a resistor R18, R22, a transmitter connected to the line Po for the first circuit and to the line No for the second circuit, and a collector connected to the common output O.

The adjustment of the resistor which determines the duration of the pulses delivered by the monostable M can be realized by adjusting the value of a variable resistor provided in the circuit 40 and serially connected between resistor R14 and line P1. This variable resistor may consist in a single variable resistance or in a plurality of resistances selectively connectable with the resistor R14.

This resistor adjustment may be realized by hand or automatically.

Figure 2:
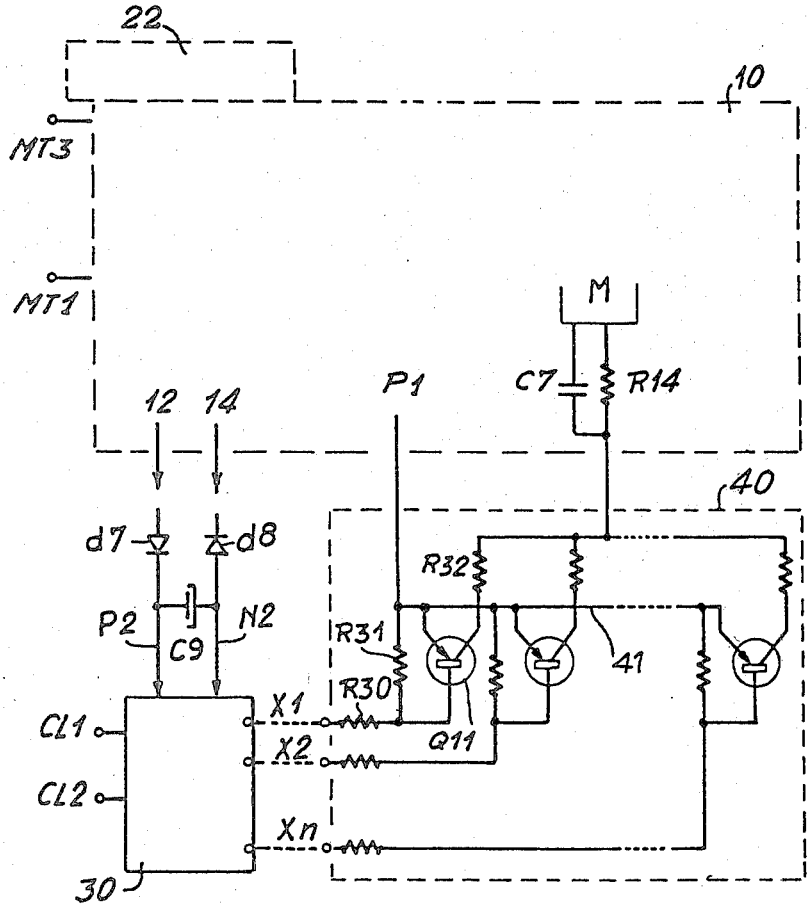
FIG. 2 is a diagram of a circuit for adjusting the duration of conduction of the switch provided in the device of FIG. 1, by modifying the value of a resistor.

FIG. 2 shows in more detail the circuit for automatically regulating the variable resistor defining the duration of the pulses delivered by the monostable M and consequently the closing time of the triac TRC. Said circuit comprises an assembly 40 including resistors whose terminals are connected to a transistor, and means 30 for controlling the opening or closing of each transistor. A resistor-transistor group comprises for example resistors R30, R31 and R32 and a transistor Q11 whose transmitter is connected to a connection line 41 joined to the positive line P1 of the circuit 10 of FIG. 1. The base of this transistor is controlled via the input terminal X1 on which is applied an appropriate voltage delivered by the circuit 30 in order to render the transistor Q11 conductive or non-conductive. The assembly 40 thus comprises a plurality of inputs X1, X2 . . . Xn controlled by the circuit 30. The insertion of a resistor, for example R11 in series with the resistor R14 is controlled by applying to the input X1 a signal able to cause the transistor Q1 to be switched on. The circuit 30 is constituted, as well known per se, by a clock and by electronic circuits in particular counting circuits, capable of generating the appropriate signals at the appropriate moments. Such a circuit raises no problem for anyone skilled in the art. Components in technology CMOS (flip-flops, gates, etc.) can be used.

Concerning the supply of circuit 30, this is obtained via two conductors P2 and N2 delivering positive and negative voltages respectively. Conductor P2 is connected, through a diode d7 to the point 12 situated between the diodes d1 and d3 of the circuit 10 or to the point 12'; the conductor N2 is joined through a diode d8 to the point 14 situated between the diodes d2 and d4 of the same circuit or to the point 14'. A capacitor C9 is connected between the conductors P2 and N2. Finally, two control inputs CL1 and CL2 are provided for the external control of the circuit 30.

Figure 3:
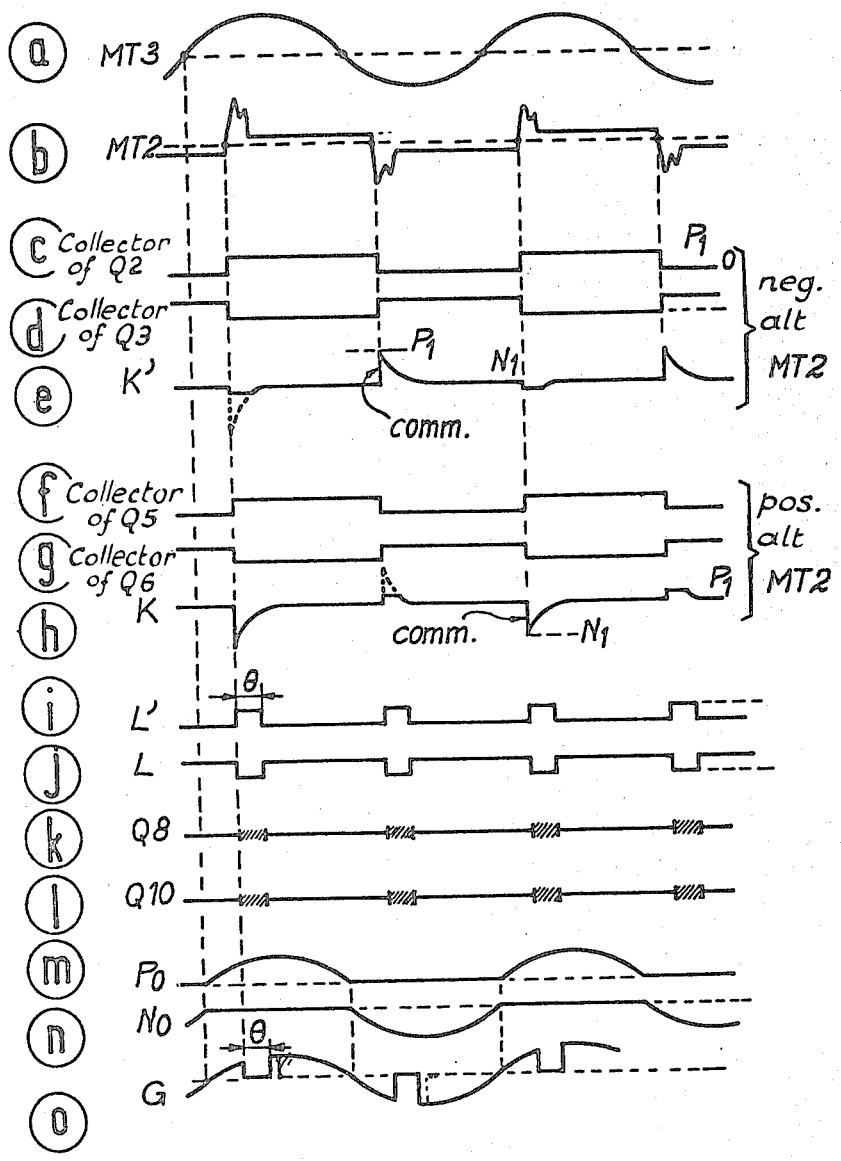
FIG. 3 is a chronogram illustrating the variation of voltages appearing in different points of the device of FIG. 1.

The control circuit according to the invention functions as illustrated by the diagrams in FIG. 3, these diagrams in fact referring only to the control circuit 10, the resistor regulating circuits 30 and 40 being easy to understand.

The line (a) in said FIG. 3 shows the A.C. voltage taken from MT3, and the line (b) the voltage taken from MT2, i.e. the voltage at the lamp terminals (these voltages are taken with respect to the mains phase present in MT1 taken as reference). It will be observed, as indicated further up, that the two illustrated voltages are not cancelled at the same moment. According to the invention, the control circuit refers to the times of passages through zero of the voltage in MT2 and not to that of the mains as in the prior art.

The lines (c) and (d) illustrate the variations of the collector voltages of the transistors Q2 and Q3 belonging to the path 16− and give the states of these transistors. The line (e) shows the positive pulse generated at K' by the differentiator circuit C3-R8, the diode 15 blocking the negative pulse. As the transistor Q3 connects the line P1 to the line N1, the pulse in question is of amplitude P1-N1. It is the leading edge of this pulse which triggers the monostable. The three lines (c), (d) and (e) illustrate how the circuit functions to detect the zero-crossing of the negative alternation of the voltage taken up in MT2.

In the same way, the lines (f) and (g) illustrate the variations of the collector voltages of the transistors Q5 and Q6 belonging to the path 16+ and give the states of these transistors. The line (h) shows the negative pulse generated in K by the differentiator circuit C4-R10, the diode d6 blocking the positive pulse. Thereagain, the transistor Q6 connecting the line N1 to the line P1, the amplitude of this negative pulse is equal to P1-N1, as for the previous circuit.

The three lines (f), (g) and (h) illustrate how the circuit functions to detect the zero-crossing of the positive alternation of the voltage taken up in MT2.

The lines (i) and (j) illustrate the complementary pulses of duration $\theta$, delivered by the monostable on its two outputs L and L'.

The lines (k) and (l) show the state of the transistors Q8 and Q10, the hachured zones corresponding to periods during which these transistors are in the non-conductive state and constitute a high impedance between the lines Po, No and the output O.

The lines (m) and (n) show the voltages to which the lines Po and No are brought, voltages in the form of positive alternations for the first, and negative alternations for the second.

Finally, the last line (o) represents the voltage appearing on the output O and which is finally applied on the control electrode G of the triac. Said voltage is formed of positive and negative arches corresponding to the voltages of the lines Po and No indented with gates of width $\theta$ corresponding to the intervals during which the transistors Q8 and Q10 are not conductive. Such a voltage is therefore of a nature of prevent the conduction of the triac through the whole period $\theta$, as indicated further up, the conduction being obtained outside these periods. This control of the triac can be obtained in any one of the four quadrants.

The variant described refers to a circuit comprising two complete dual paths of treatment (the paths 16− and 16+ and the circuits 18 and 18') but it would not be departing from the scope of the invention to use only one path of treatment (such as for example the path 16− and the circuit 18', or the path 16+ and the circuit 18) to consider only the alternations of a certain sign, or else of the voltage at the load terminals, or of the control voltage generated downstream of one of the two outputs of the monostable.

The invention of course is not limited to the description given hereinabove with reference to a discharge lamp and could on the contrary by applied to the control of other lamps, or of other impedances, and even to capacitance or resistance loads.

What is claimed is:

1. A control device for a discharge lamp, comprising an electronic switch having a control electrode and connected between a terminal for connection, with an AC supply source, and a terminal for connection with a loading circuit including the discharge lamp to be controlled, and a control circuit for delivering control pulses applied to said control electrode for controlling the state of said switch, wherein said comprises a circuit for detecting the passages through zero of the voltage at the terminals of said loading circuit, generating means connected to said detecting circuit and responsive to passages through zero of the current through said discharge lamp for providing control pulses having an adjustable duration and means for receiving said control pulses and connected to said control electrode for maintaining the electronic switch in a non-conductive state during the duration of said control pulses.

2. A device as claimed in claim 1, wherein the control pulses generating means comprises a monostable circuit which is triggered by signals delivered by said zero-crossing detecting circuit.

3. A device as claimed in claim 1, wherein a circuit is provided for adjusting the duration of the control pulses and wherein said adjusting circuit and said control circuit have conductive supply lines connected to terminals for connection with said A.C. supply source.

4. A device as claimed in claim 1, wherein the detecting circuit comprises two symmetrical detecting paths receiving respectively the negative alternations and the positive alternations of the voltage at the terminals of the loading circuit and responsive respectively to the passages through zero of positive alternations and negative alternations of the current through said electric load for delivering first and second signals on respective separate outputs of said detecting circuit.

5. A device as claimed in claim 3, wherein the control pulse generating means receives said first and second signals and delivers in response first and second signals of identical adjustable duration.

6. A device as claimed in claim 5, wherein said generating means includes a monostable circuit of adjustable time period comprising two complementary inputs connected respectively to said two outputs of said detecting paths, and comprising two outputs for delivering complementary rectangular pulses of identical duration.

7. A device as claimed in claim 6, wherein a conductive supply line assembly is provided, which lines are connected to first and second terminals of connection to the A.C. supply source and comprising: a first positive conductive line connected to the first input terminal via a first rectifier circuit for passing the positive alternations of the A.C. supply phase present on the said first input terminal, a first negative conductive line connected to the first input terminal via a second rectifier circuit for passing the negative alternations of the A.C. supply phase present on the said first input terminal, a conductive line of reference connected to the second input terminal, a second positive conductive line connected to the first input terminal via a third rectifier circuit and to the reference line via a circuit constituted by a first Zener diode and by a first shunt capacitor, and a second conductive line connected to the first input terminal via a fourth rectifier circuit and to the reference line via a circuit constituted by a second Zener diode and by a second shunt capacitor.

8. A device as claimed in claim 7, wherein said loading circuit has first and second (MT2) connection terminals connected respectively to said first input terminal and to the electronic switch; and wherein said first detecting path is supplied by the said second negative line, and comprises a signal input connected to the second connection terminal of the loading circuit, and means to deliver a pulse on an output (K), at the time of said zero crossing detected by said first detecting path and wherein said second detecting path is symmetrical to the first, is supplied by the second positive line (P1), and comprises a signal input connected to the second terminal of the charge (MT2), and means to deliver a pulse on an output (K') during said zero-crossing detected by said second detecting path, the polarity of said last named pulse being reverse to that delivered by the first path.

9. A device as claimed in claim 8, wherein each of the first and second detecting paths comprises: a first transistor whose base is connected to said second connection terminal, a collector connected to said second positive line for the first path and to said second negative line for the second path, and a transmitter connected to said reference line; a second transistor whose base is connected to said reference line and a collector connected to said second positive line for the first path and to said second negative line for the second path; a third transistor whose base is connected to the collector of said second transistor, a transmitter connected to said second positive line for the first path and to said second negative line for the second path, and a collector connected to said second negative line for the first path and to said second positive line for the second path, the transmitter-collector circuit of said third transistor being thus inserted between said second positive line and said second negative line; and a differentiator circuit connected to the collector of the third transistor and delivering a pulse on an output terminal in response to the passage through zero of the voltage at said second connection terminal, a negative pulse for the positive alternation and a positive pulse for the negative alternation of said last-named voltage.

10. A device as claimed in claim 8, wherein said means for receiving control pulses which is connected to said control electrode comprises:

a positive receiving circuit supplied by said first positive line and said reference line, and comprising a control input connected to a first output of said monostable, an output, and means capable of delivering a voltage pulse on said last-named output, which voltage pulse is zero throughout the duration of the pulse appearing at the first output of said monostable, a negative receiving circuit, symmetrical to the positive receiving circuit, supplied by said first negative line and by said reference line, and comprising a control input connected to a second output of the monostable, said receiving circuit comprising the same output as the positive receiving circuit, and means capable of delivering a voltage pulse on said same output, which voltage pulse is zero throughout the duration of the pulse appearing at the second output of said monostable, and further comprising a connection line connecting the output common to both the positive and negative receiving circuits to the control electrode of the switch, which switch is thus in the non-conductive state throughout the duration of cancellation of the signals present on said common output and in the conductive state outside this period.

11. A device as claimed in claim 8, wherein said means for receiving control pulses which is connected to said control electrode comprises:

a positive receiving circuit supplied by said first positive line and said reference line, and comprising a control input connected to an output of said monostable, an output, and means capable of delivering a voltage pulse on said last-named output, which voltage pulse is zero throughout the duration of the pulse appearing at the output of said monostable, and further comprising a connection line connecting the output of the positive receiving circuit to the control electrode of the switch, which switch is thus in the non-conductive state throughout the duration of cancellation of the signals present on the output of the positive receiving circuit and in the conductive state outside this period.

12. A device as claimed in claim 8, wherein said means for receiving control pulses which is connected to said control electrode comprises:

a negative receiving circuit supplied by said first negative line and by said reference line, and comprising a control input connected to an output of the monostable, an output, and means capable of delivering a voltage pulse on said last-named output, which voltage pulse is zero throughout the duration of the pulse appearing at the output of said monostable, and further comprising a connection line connecting the output of the negative receiving circuit to the control electrode of the switch, which switch is thus in the non-conductive state throughout the duration of cancellation of the signals present on the output of the negative receiving circuit and in the conductive state outside this period.

13. A device as claimed in claim 1, wherein a circuit is provided for the regulation of the control pulse duration, which circuit comprises resistors being each connected to a transistor, and means for controlling the opening and closing of each transistor.

* * * * *

UNITED STATES PATENT AND TRADEMARK OFFICE

CERTIFICATE OF CORRECTION

PATENT NO. : 4,388,565

DATED : June 14, 1983

INVENTOR(S) : Jan Rividi

It is certified that error appears in the above-identified patent and that said Letters Patent are hereby corrected as shown below:

In the Claims

Claim 1, column 6, line 66 the words --control circuit-- should be inserted before the word "comprises"

Signed and Sealed this

*Fifteenth* Day of *November 1983*

[SEAL]

*Attest:*

GERALD J. MOSSINGHOFF

*Attesting Officer*

*Commissioner of Patents and Trademarks*